US008643493B1

(12) United States Patent
Klitenick et al.

(10) Patent No.: US 8,643,493 B1
(45) Date of Patent: Feb. 4, 2014

(54) CHILD MONITORING SYSTEM

(76) Inventors: Richard M. Klitenick, Key West, FL (US); Marcus P. Varner, Key West, FL (US); Len Deweerdt, Canandaigua, NY (US); Omar Garcia, Key West, FL (US); Walter De Milly, Key West, FL (US)

( * ) Notice: Subject to any disclaimer, the term of this patent is extended or adjusted under 35 U.S.C. 154(b) by 815 days.

(21) Appl. No.: 12/655,852

(22) Filed: Jan. 8, 2010

(51) Int. Cl.
*G08B 23/00* (2006.01)

(52) U.S. Cl.
USPC ..... 340/573.1; 340/667; 340/457

(58) Field of Classification Search
USPC ..... 340/457, 10.1, 573.1, 686.1, 539.1, 340/522, 667
See application file for complete search history.

(56) References Cited

U.S. PATENT DOCUMENTS

| | | | | |
|---|---|---|---|---|
| 5,289,163 | A * | 2/1994 | Perez et al. | 340/539.32 |
| 5,949,340 | A * | 9/1999 | Rossi | 340/573.1 |
| 6,104,293 | A * | 8/2000 | Rossi | 340/573.1 |
| 6,377,177 | B1 * | 4/2002 | Broussard et al. | 340/573.1 |
| 6,535,137 | B1 * | 3/2003 | Ryan | 340/687 |
| 6,593,851 | B1 * | 7/2003 | Bornstein | 340/539.15 |
| 6,847,302 | B2 * | 1/2005 | Flanagan et al. | 340/666 |
| 7,009,522 | B2 * | 3/2006 | Flanagan et al. | 340/666 |
| 7,218,218 | B1 * | 5/2007 | Rogers | 340/522 |
| 7,339,463 | B2 * | 3/2008 | Donaldson | 340/457 |
| 7,554,444 | B2 | 6/2009 | Rao | |
| 7,592,905 | B2 * | 9/2009 | Barton et al. | 340/457 |
| 7,697,891 | B2 * | 4/2010 | Desrosiers et al. | 455/39 |
| 8,038,213 | B2 * | 10/2011 | Owens | 297/250.1 |
| 8,058,983 | B1 * | 11/2011 | Davisson et al. | 340/457 |
| 2003/0062996 | A1 * | 4/2003 | Flanagan et al. | 340/457 |
| 2003/0122662 | A1 * | 7/2003 | Quinonez | 340/457 |
| 2005/0030188 | A1 * | 2/2005 | Flanagan et al. | 340/667 |
| 2008/0309493 | A1 * | 12/2008 | Lee et al. | 340/572.1 |

* cited by examiner

*Primary Examiner* — Hoi Lau

(57) ABSTRACT

A monitoring pendant is coupled to a person, thing or animal being monitored and is adapted to transmit and receive signals to and from a key chain fob and to and from a base unit. The key chain fob is coupled or integrated into something a guardian would carry such as a set of keys, cell phone or electronics and is adapted to transmit and receive signals to and from the monitoring pendant and to and from the base unit. The base unit is coupled to the vehicle and is adapted to transmit and receive signals to and from the monitoring pendant and to and from the key chain fob.

4 Claims, 3 Drawing Sheets

FIG 3
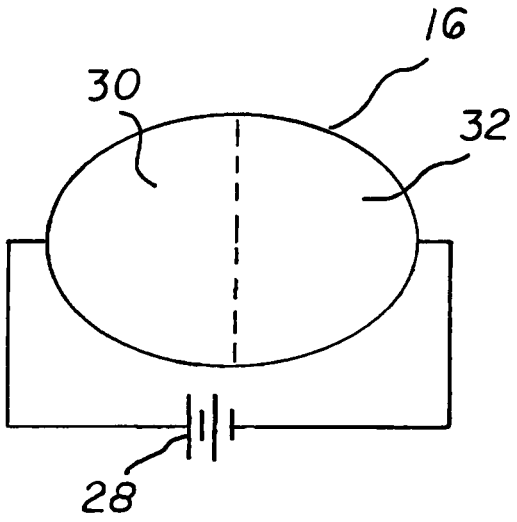
FIG 4
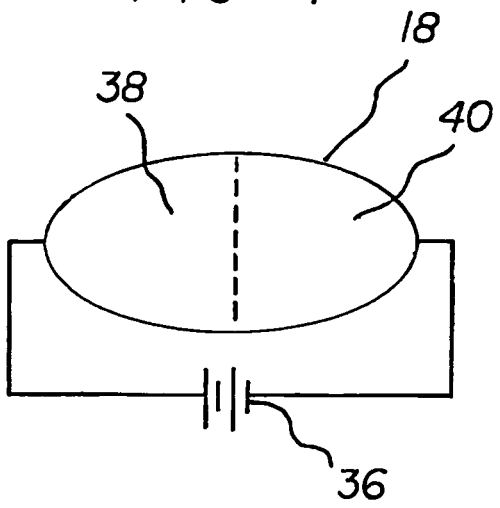
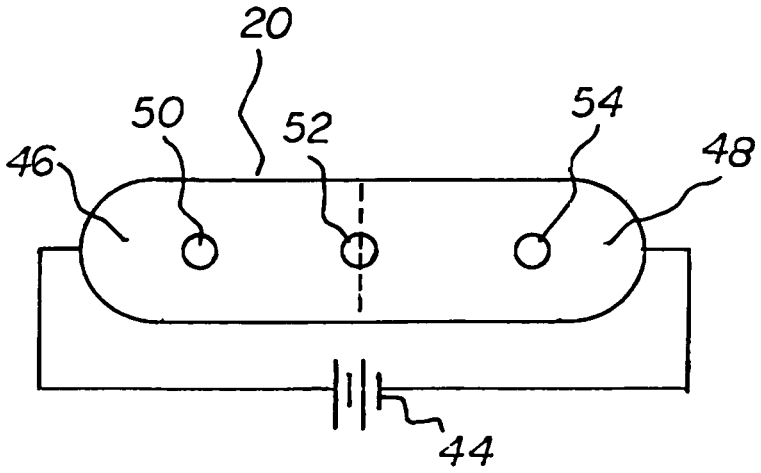
FIG 5

FIG 6
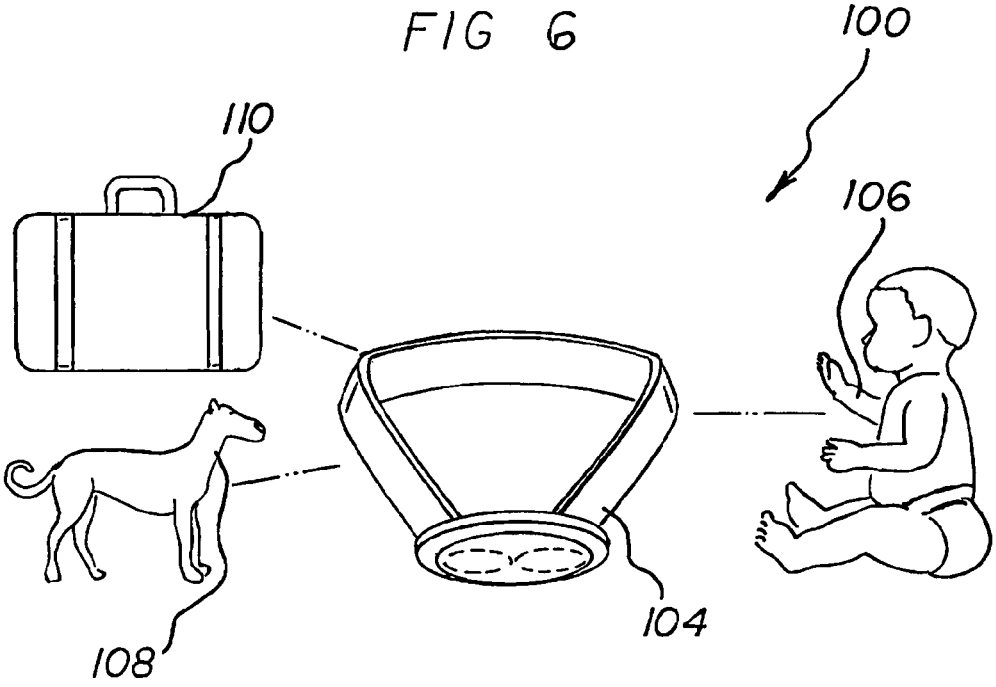
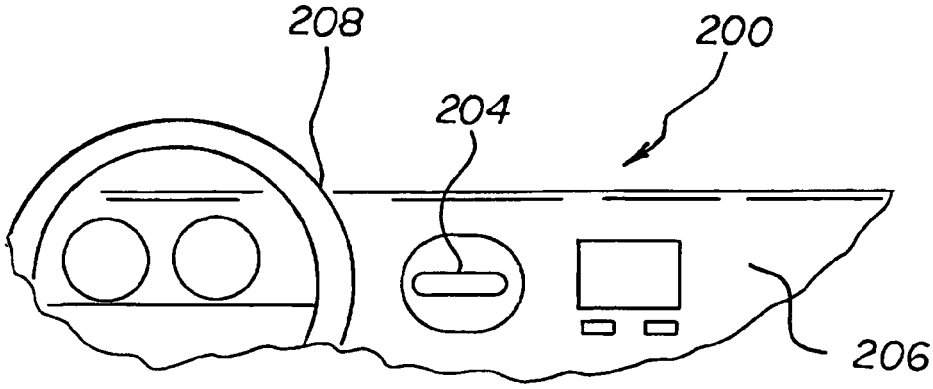
FIG 7

CHILD MONITORING SYSTEM

BACKGROUND OF THE INVENTION

1. Field of the Invention

The present invention relates to a child monitoring system and more particularly pertains to detecting a person, animal, luggage or other valuable left unattended in an unoccupied place such as a vehicle and for generating a warning signal to a guardian in response to the detection.

2. Description of the Prior Art

The use of child monitoring systems of known designs and configurations is known in the prior art. More specifically, child monitoring systems of known designs and configurations previously devised and utilized for the purpose of alerting a driver that an child has been left unattended in a vehicle are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 7,554,444 issued Jun. 30, 2009 to Rao relates to a System and Method for Alarm Generation Based on the Detection of the Presence of a Person. U.S. Pat. No. 7,009,522 issued Mar. 7, 2006 to Flanagan discloses an Object Proximity Monitoring and Alarm System. Lastly, U.S. Pat. No. 7,339,463 issued Mar. 4, 2008 to Donaldson discloses an Infant Alert System and Method Thereof.

While these devices fulfill their respective, particular objectives and requirements, the aforementioned patents to not describe a monitoring system that allows detecting a person, animal, luggage or other valuable left unattended in an unoccupied place such as a vehicle and for generating a warning signal to a guardian in response to the detection.

Therefore, it can be appreciated that there exists a continuing need for a new and improved child monitoring system which can be used for detecting a person, animal, luggage or other valuable left unattended in an unoccupied place such as a vehicle and for generating a warning signal to a guardian in response to the detection. In this regard, the present invention as described herein in various embodiments of the invention, substantially fulfills this need.

SUMMARY OF THE INVENTION

In view of the foregoing disadvantages inherent in the known types of child monitoring systems of known designs and configurations now present in the prior art, the present invention provides an improved child monitoring system. As such, the general purpose of the present invention, which will be described subsequently in greater detail, is to provide a new and improved person, animal, luggage or other valuable monitoring system and method which has all the advantages of the prior art and none of the disadvantages.

To attain this, the present invention essentially comprises a monitoring system for detecting something left behind, such as a child in a vehicle, and for generating a warning signal to the guardian in response to the detection. Provided are a monitoring pendant and a key chain fob and a base unit.

The monitoring pendant has a housing with a means to attach it to a person, animal or object. The means to attach it can include but are not limited to an elastic band, bracelet, pin or button. The housing has a power source. The housing also has electronics including a transmitter adapted to transmit signals to the key chain fob and to the base unit. The electronics also include a receiver adapted to receive signals from the key chain fob and from the base unit.

The key chain fob is adapted to be carried along with the keys of a driver of a vehicle, as a stand alone monitoring device or as an attachment to other portable devices including a cell phone or portable computer. The key chain fob has a power source. The key chain fob also has electronics. The electronics include a transmitter adapted to transmit signals to the monitoring pendant and to the base unit. The electronics include a receiver adapted to receive signals from the monitoring pendant and from the base unit.

The base unit is adapted to be coupled to a particular location, such as a vehicle at one of a plurality or preselected locations, or integrated into a car's computer or electronic warning system. In such a case, the device's controls and indicator lights may be designed into the automobile's dashboard, console, or other components visible to the driver. The preselected locations include, but are not limited to, a top of a dashboard, a rear-view mirror, a window, a front of a dashboard and a ceiling. The base unit has a source of power and electronics. The electronics include a transmitter adapted to transmit signals to the monitoring pendant and to the key chain fob. The electronics also include a receiver adapted to receive signals from the monitoring pendant and from the key chain fob. The base unit includes a power light adapted to be illuminated when power is supplied to the system. The base unit also includes an active light adapted to be illuminated when the monitoring pendant, the key chain fob and the base unit are in operative proximity to each other whereby the system is active. If the base unit is incorporated into the automobile's computer or electronic system, the indicator lights may be separated from the base unit so that they are displayed in a dashboard, console or other location in the car visible to the driver. Operative proximity in the preferred embodiment means within 20 feet of each other, but that distance can be user selectable. The base unit also includes a warning light/audio alarm adapted to be illuminated and sounded to warn the guardian.

The warning light/audio alarm is adapted to be energized and the system is adapted to be inactivated when the monitoring pendant and the base unit are out of operative proximity or outside a pre-determined range of each other. In the preferred embodiment out of operative proximity is outside of 20 feet of each other, but that distance can be user selectable.

The warning light/audio alarm is adapted to be energized and the system adapted to be inactivated when the key chain fob and the base unit are out of operative proximity of each other. Again, in the preferred embodiment out of operative proximity is outside of 20 feet of each other, but that distance can be user selectable. In the case of multiple items being monitored, the alert can be disabled momentarily, such as when numerous children are entering or exiting a vehicle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart form the spirit and scope of the present invention.

It is therefore an object of the present invention to provide a new and improved child monitoring system which has all of the advantages of the prior art child monitoring systems of known designs and configurations and none of the disadvantages.

It is another object of the present invention to provide a new and improved child monitoring system which may be easily and efficiently manufactured and marketed.

It is further object of the present invention to provide a new and improved child monitoring system which is of durable and reliable constructions.

An even further object of the present invention is to provide a new and improved child monitoring system which is susceptible of a low cost of manufacture with regard to both materials and labor, and which accordingly is then susceptible of low prices of sale to the consuming public, thereby making such child monitoring system economically available to the buying public.

Even still another object of the present invention is to provide a monitoring system for detecting a person, animal, luggage or other valuable left unattended in an unoccupied place and for generating a warning signal to a guardian in response to the detection.

Lastly, it is an object of the present invention to provide a new and improved child monitoring system having a monitoring pendant, a key chain fob and a base unit. The monitoring pendant is coupled to a recipient being monitored and is adapted to transmit and receive signals to and from a key chain fob and to and from a base unit. The key chain fob is coupled to something a guardian would carry such as a set of keys, cell phone or electronics and is adapted to transmit and receive signals to and from the monitoring pendant and to and from the base unit. The base unit is coupled to the vehicle and is adapted to transmit and receive signals to and from the monitoring pendant and to and from the key chain fob.

These together with other object of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 3, 4 and 5 are electrical schematic illustrations of the various components of the system.

FIG. 6 is a perspective showing of an alternate embodiment of the invention showing the monitoring pendant coupleable to any of a plurality of recipients.

FIG. 7 is a perspective showing of another alternate embodiment of the invention showing the base unit secured with respect to the dashboard of a vehicle.

The same reference numerals refer to the same parts throughout the various Figures.

DESCRIPTION OF THE PREFERRED EMBODIMENT

Figure 1:
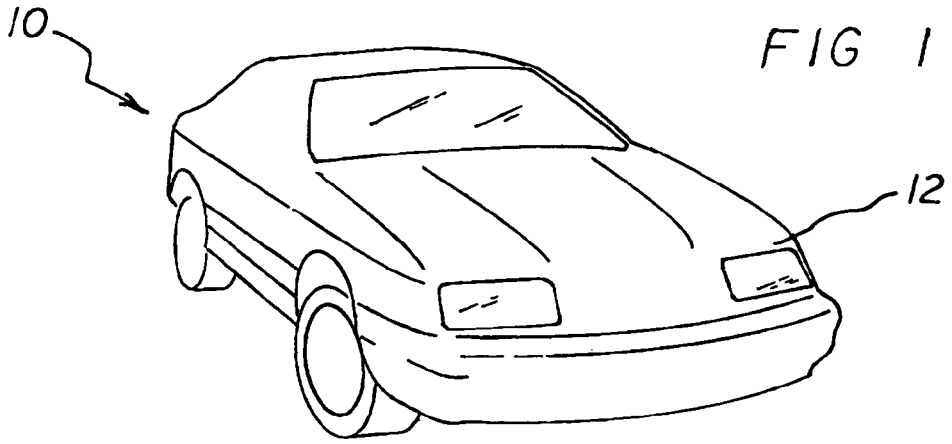
FIG. 1 is a perspective illustration of a child monitoring system constructed in accordance with the principles of the present invention.
Figure 2:
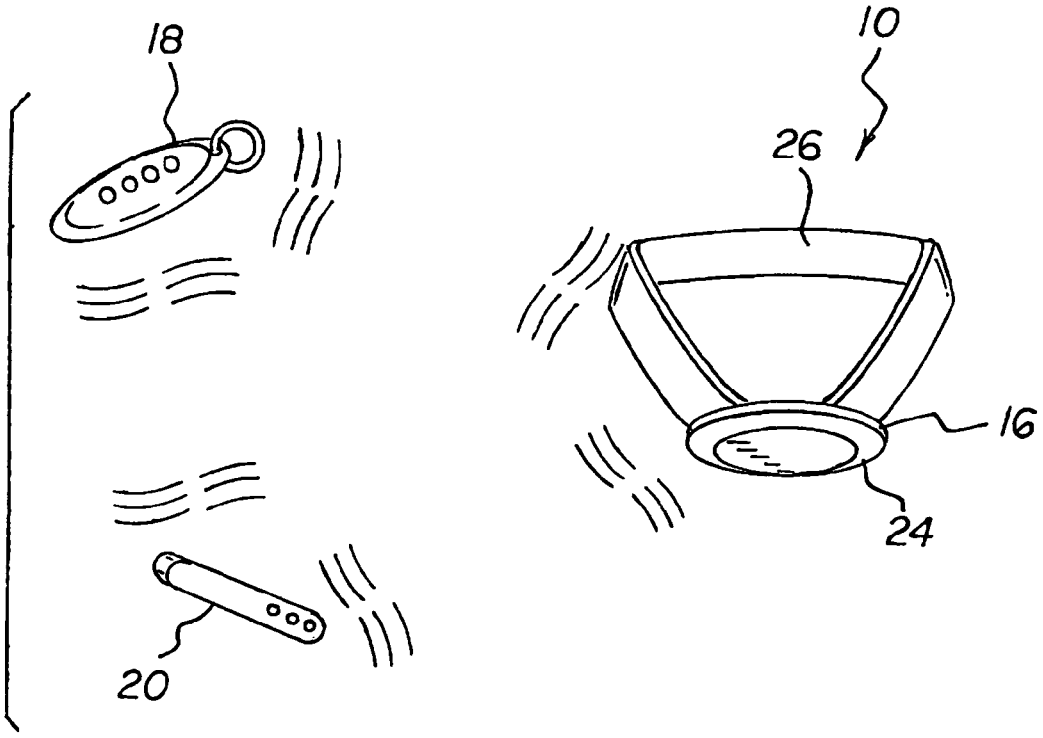
FIG. 2 is a perspective illustration of the components of the system of FIG. 1.

With reference now to the drawings, and in particular to FIG. 1 thereof, the preferred embodiment of the new and improved child monitoring system embodying the principles and concepts of the present invention and generally designated by the reference number 10 will be described.

The present invention, the child monitoring system 10 is comprised of a plurality of components. Such components in their broadest context include a monitoring pendant, a key chain fob, and a base unit. Such components are individually configured and correlated with respect to each other so as to attain the desired objective.

The child monitoring system 10 of the present invention is for detecting a child left unattended in an otherwise unoccupied vehicle 12 and for generating a warning signal to a driver in response to the detection. Provided are a monitoring pendant 16 and a key chain fob 18 and a base unit 20.

The monitoring pendant has a housing 24 with an elastic band 26 for removably securing the housing to a child being monitored. The housing has a power source 28. The housing also has electronics including a transmitter 30 adapted to transmit signals to the key chain fob and to the base unit. The electronics also include a receiver 32 adapted to receive signals from the key chain fob and from the base unit.

The key chain fob is adapted to be coupled to keys of a driver of a vehicle. The key chain fob has a power source 36. The key chain fob also has electronics. The electronics include a transmitter 38 adapted to transmit signals to the monitoring pendant and to the base unit. The electronics include a receiver 40 adapted to receive signals from the monitoring pendant and from the base unit.

The base unit is adapted to be coupled to the vehicle at one of a plurality of preselected locations. The preselected locations include, but are not limited to, a top of a dashboard, a rear-view mirror, a window, a front of a dashboard and a ceiling. The base unit has a source of power 44 and electronics. The electronics include a transmitter 46 adapted to transmit signals to the monitoring pending and to the key chain fob. The electronics also include a receiver 48 adapted to receive signals from the monitoring pendant and from the key chain fob. The base unit includes a power light 50 adapted to be illuminated when power is supplied to the system. The base unit also includes an active light 52 adapted to be illuminated when the monitoring pendant, the key chain fob and the base unit are in operative proximity to each other whereby the system is active. Operative proximity in the preferred embodiment means with 20 feet of each other, but that distance can be user selectable. The base unit also includes a warning light/audio alarm 54 adapted to be illuminated and sounded to warn the driver.

The warning light/audio alarm is adapted to be energized and the system is adapted to be inactivated when the monitoring pendant and the base unit are out of operative proximity of each other. In the preferred embodiment out of operative proximity is outside of 20 feet of each other.

The warning light/audio alarm is adapted to be energized and the system adapted to be inactivated when the key chain fob and the base unit are out of operative proximity of each other. Again, in the preferred embodiment out of operative proximity is outside of 20 feet of each other, but that distance can be user selectable.

A first alternate embodiment of the system 100 is illustrated in FIG. 6. In this embodiment, the monitoring pendant 104 is removably coupled to a recipient chosen from a group of recipients including a person 106, an animal 108 and a piece of luggage 110.

A final alternate embodiment of the system 200 is illustrated in FIG. 7. In this embodiment, the base unit 204 is secured within the dashboard 206 of a vehicle 208 and the power is supplied to the base unit from a battery or other power source of the vehicle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A recipient monitoring system comprising:

a monitoring pendant and a key chain fob and a base unit; the monitoring pendant coupled to a person, animal or item being monitored, the monitoring pendant adapted to transmit and receive signals to and from the key chain fob and to and from the base unit;

the key chain fob coupled or integrated into a set of keys, cell phone or electronics, the key chain fob adapted to transmit and receive signals to and from the monitoring pendant and to and from the base unit; and the base unit coupled to an item/location, the base unit adapted to transmit and receive signals to and from the monitoring pendant and to and from the key chain fob;

wherein the base unit includes or is connected to a power light adapted to be illuminated when power is supplied to the system, the base unit also including or is connected to an active light adapted to be illuminated when the system is active, the base unit also including a warning alarm adapted to be energized to generate a warning, the active light adapted to be energized and the system adapted to be activated when the monitoring pendant and the key chain fob and the base unit are in operative proximity of each other;

wherein the warning alarm is adapted to be energized by a timer, if no response from the base unit occurs after a user selectable time passes, the system is also adapted to be inactivated when the monitoring pendant and the base unit are out of operative proximity of each other, the warning alarm adapted to be energized and the system adapted to be inactivated when the key chain fob and the base unit are out of operative proximity of each.

2. The system as set forth in claim 1 wherein the monitoring pendant is removably coupled to the recipient and the recipient is a recipient being chosen from a group of recipients include a person, an animal and a piece of luggage or other object.

3. The system as set forth in claim 1 wherein the base unit is secured within a vehicle and wherein power is supplied to the base unit from a vehicle power source.

4. A child monitoring system for detecting a child left unattended in an otherwise unoccupied vehicle and for generating a warning signal to a driver in response to the detection, the system comprising, in combination:

a monitoring pendant and a key chain fob and a base unit; the monitoring pendant having a housing with an attaching means including an elastic band, bracelet, pin or button for removably securing the housing to a person, animal or item being monitored, the housing having a power source and monitoring pendant electronics including a transmitter adapted to transmit signals to the key chain fob and to the base unit, the monitoring pendant electronics also including a receiver adapted to receive signals from the key chain fob and from the base unit;

the key chain fob adapted to be coupled or integrated into a set of keys, cell phone or electronics, the key chain fob having a power source and key chain fob electronics including a transmitter adapted to transmit signals to the monitoring pendant and to the base unit, the key chain fob electronics also including a receiver adapted to receive signals from the monitoring pendant and from the base unit;

the base unit adapted to be coupled to the vehicle at one of a plurality of preselected locations or integrated into a car's computer or electronic warning system, in such a case, the device's controls and indicator lights may be designed into the automobile's dashboard, console, or other components visible to a driver, the preselected locations including a top of a dashboard, a rear-view mirror, a window, a front of a dashboard and a ceiling, the base unit having a source of power and base unit electronics including a transmitter adapted to transmit signals to the monitoring pendant and to the key chain fob, the base unit electronics also including a receiver adapted to receive signals from the monitoring pendant and from the key chain fob, the base unit including a power light adapted to be illuminated when power is supplied to the system, the base unit also including an active light adapted to be illuminated when the monitoring pendant, the key chain fob and the base unit are in operative proximity to each other, within 20 feet of each other, whereby the system is active, the base unit also including a warning light/audio alarm adapted to be illuminated and sounded to warn the driver;

the warning light/audio alarm adapted to be energized and the system adapted to be inactivated when the monitoring pendant and the base unit are out of operative proximity of each other, outside of 20 feet of each other, or outside of a user selectable perimeter;

the warning light/audio alarm adapted to be energized and the system designed to be inactivated when the key chain fob and the base unit are out of operative proximity of each other, outside of 20 feet of each other, or outside of a user selectable perimeter.

* * * * *